US009596530B2

(12) United States Patent
Clark

(10) Patent No.: US 9,596,530 B2
(45) Date of Patent: Mar. 14, 2017

(54) CONFIGURABLE SPEAKER

(71) Applicant: Bose Corporation, Framingham, MA (US)

(72) Inventor: Andrew W. Clark, Shrewsbury, MA (US)

(73) Assignee: Bose Corporation, Framingham, MA (US)

( * ) Notice: Subject to any disclaimer, the term of this patent is extended or adjusted under 35 U.S.C. 154(b) by 244 days.

(21) Appl. No.: 14/399,746

(22) PCT Filed: May 7, 2013

(86) PCT No.: PCT/US2013/039815
§ 371 (c)(1),
(2) Date: Nov. 7, 2014

(87) PCT Pub. No.: WO2013/169694
PCT Pub. Date: Nov. 14, 2013

(65) Prior Publication Data

US 2015/0125018 A1 May 7, 2015

Related U.S. Application Data

(60) Provisional application No. 61/643,846, filed on May 7, 2012.

(51) Int. Cl.

| | |
|---|---|
| ***H04R 1/02*** | (2006.01) |
| ***H04R 9/06*** | (2006.01) |
| ***H04R 5/02*** | (2006.01) |
| ***H04R 31/00*** | (2006.01) |
| ***H04R 1/28*** | (2006.01) |

(52) U.S. Cl.
CPC ..... *H04R 1/026* (2013.01); *H04R 1/02* (2013.01); *H04R 1/025* (2013.01); *H04R 1/283* (2013.01); *H04R 5/02* (2013.01); *H04R 31/00* (2013.01); *H04R 2201/028* (2013.01); *Y10T 29/49716* (2015.01)

(58) Field of Classification Search
CPC . H04R 1/025; H04R 1/02; H04R 5/02; H04R 31/00; Y10T 29/49716
USPC ..... 381/332
See application file for complete search history.

(56) References Cited

U.S. PATENT DOCUMENTS

| | | | | |
|---|---|---|---|---|
| 6,292,573 B1 * | 9/2001 | Zurek | ..... | H04R 1/2811 379/428.01 |
| 2011/0000740 A1 * | 1/2011 | Carter | ..... | H04R 1/02 181/199 |

* cited by examiner

*Primary Examiner* — Paul S Kim

(57) ABSTRACT

A deployable speaker includes a driver and an acoustic enclosure made up of a multiplicity of panels. The driver is secured to one of the panels. The acoustic enclosure is deployable from a closed state to a deployed state. When one of the panels is moved by a user from the closed to the deployed state, all but one of the remaining panels are simultaneously moved from the closed to the deployed state.

18 Claims, 8 Drawing Sheets

CONFIGURABLE SPEAKER

CROSS-REFERENCE TO RELATED APPLICATIONS

This application claims benefit from U.S. Provisional Patent Application No. 61/643,846, filed May 7, 2012, the contents of which are incorporated herein by reference.

BACKGROUND

Small portable electronic devices that contain a speaker cannot generate significant open-air acoustic output at frequencies below approximately 250 Hz (the low-frequency cutoff point, 262 Hz corresponds to "middle C"). This limitation negatively affects the sound of these devices (giving it a thin, unnatural and somewhat unpleasant character) and also prevents the transmission of important musical content below the cutoff frequency. At present, the discriminating user must connect his device to large external speakers or resort to headphones to enjoy the full audio experience.

Extending the open-air (ambient) frequency response below 250 Hz requires a larger diaphragm to move more air and an increasing enclosure volume. The moving diaphragm generates pressure waves perceived by the ear. In general, as the enclosure volume increases, the frequency range of the system (over which the diaphragm can effectively resonate and produce significant acoustic energy) extends to lower frequencies. In a manner proportional to the volume, the size and weight of the system also increase and the speaker's portability is compromised.

The Samsung ESP-210 product includes a small stereo speaker pair on a baffle that folds along an axis perpendicular to the line joining the centers of the left and right speakers. The folding aspect of the product has no bearing on the frequency response of the system. Power is 3AAA or u-USB. There are other brands of product using this configuration. An important point is that the concept of "folding" when applied to portable speakers generally refers to collapsing the relative location of the drivers with respect to each other, rather than reducing the volume of the acoustic enclosure itself.

The XMI X-Mini 2 product includes a roughly 3" spherical speaker system that pops open along a plane passing through its center. The 40 mm (1.6") driver points upward from the top of the upper hemisphere. The two hemispheres are connected by a pleated tube which maintains the enclosure volume, which appears to increase slightly when the device is open. It has a rechargeable battery and can be connected to a USB power source.

The XMI X-Mini Max 2 product includes a cone-shaped capsule version of the product just above to provide a "bass expansion system" that "creates an extendable vacuum, which is capable of producing bass over ten times what the physical size of these speakers would normally allow." The claimed frequency response is 200-18 kHz. The power is 2.5 W for each speaker. The impedance is 4 ohms. There is a built-in rechargeable battery with a 2.5 hr charge time and 12 hr playback time.

The Satechi SX2 product is roughly cylindrical and pops open similar to the XMI products above.

The Bose Soundlink Wireless Mobile Speaker includes a larger fixed-size battery-powered speaker/amplifier marketed as portable. The size of this product is 5" H×10" W×2" D (100 ci) and the weight is 3 lbs (price is $300). There is no frequency response or amplifier power information in the specification or manual. The speaker contains 4 small (~1.8") long-throw drivers (2 one each side), with 2 opposed passive radiators (~3"×5") in the center pointing front and rear. This product also contains 2 circuit boards, one for button interface on the top and the other for the wireless receiver, processor and amplifier. There is a tubular-shaped battery compartment in the bottom. A full charge is said to power the unit at full volume for 3 hours, and the recommended charging time is also 3 hours. The charger rating is 17V 1 A, so the Li-Ion battery may be composed of 4×CR123 cells. There is also a usb "service connector" which is only for software updates, and cannot be used to charge or play music.

The Wowee One Power Bass Portable Speaker is a small (60×120×26 mm) battery powered speaker system containing a mid-high frequency driver and a "gel audio" (SFX Technologies Ltd) low-frequency driver which (in combination with an external flat surface) is claimed to deliver frequency response down to 40 Hz. Adhesive pads are used to affix the unit to the surface and prevent vibration. The device contains an internal Li-Ion battery and 2 W class-D amplifier. Inputs include a ⅛" phone jack and mini-usb IEEE 1394 power jack. 2nd generation products are enhanced with a slimmer profile (16 mm thick) and/or Bluetooth wireless capability.

SUMMARY

All examples and features mentioned below can be combined in any technically possible way.

In one aspect, a deployable speaker includes a driver and an acoustic enclosure made up of a multiplicity of panels. The driver is secured to one of the panels. The acoustic enclosure is deployable from a closed state to a deployed state. When one of the panels is moved by a user from the closed to the deployed state, all but one of the remaining panels are simultaneously moved from the closed to the deployed state.

Embodiments may include one of the following features, or any combination thereof. The enclosure has a total of five panels. A living hinge connects each panel to at least one other panel. The speaker further includes a pair of link mechanisms which both have one end connected to the one panel that is moved by the user and the other end connected to a respective other panel. The speaker further includes one or more filaments which are connected to all but one of the panels and are pulled by the user to move the all but one of the panels from the closed state to the deployed state. In the deployed state all but one of the panels each has at least two edges that engage with a respective portion of at least two other panels. In the closed state the at least two edges of the all but one of the panels are not engaged with the respective portions of the at least two other panels. In the deployed state a first two of the panels each have two edges that engage with a respective portion of two other panels, and a second two of the panels each have three edges that engage with a respective portion of three other panels. All of the panels which make up the enclosure are unitary and formed from a single sheet of material. The acoustic enclosure is substantially air tight. The enclosure includes at least one opening which functions as a port. The enclosure has a passive radiator. The speaker further includes one or more of a battery, an amplifier and electronics which are contained in the enclosure.

In another aspect, a method of deploying a speaker from a closed state to an deployed state includes providing an enclosure in a closed state which is made up of a multiplicity of panels. A driver is secured to one of the panels. A first one of the panels is unfolded from the remaining panels. A deployment element is moved to cause the remaining panels to simultaneously move from respective first positions to respective second positions in which the enclosure is in the deployed state.

Embodiments may include one of the above and/or below features, or any combination thereof. The driver is secured to a second one of the panels. The deployment element is a tab which is pulled by a user to cause the moving step. The method further includes securing the deployment element to lock the enclosure in the deployed state. The deployment element is moved in a first direction to cause the remaining panels to simultaneously move from respective first positions to respective second positions, and is moved in a second direction to secure the deployment element. Each of the unfolding and moving steps are enabled by living hinges which join the panels together.

In yet another aspect, a deployable speaker includes a driver and an enclosure made up of a multiplicity of panels. The driver is secured to one of the panels. The enclosure is deployable from a closed state to a deployed state. All of the panels which make up the enclosure are unitary and formed from a single sheet of composite material having an interior layer that includes a first type of material which is skinned in a second type of material.

Embodiments may include one of the above and/or below features, or any combination thereof. The first type of material is a plastic. The plastic is selected from the group consisting of polypropylene and polyethylene. The second type of material is a metal. The metal is aluminum.

DETAILED DESCRIPTION

This FPS significantly alters the balance of the size versus performance limitation resulting from the design considerations listed above. The enclosure folds flat and thus may be carried in a purse or pocket, and may also be integrated with (or within) a protective case for a portable electronic device (which provides the audio signal and/or content). The FPS differs physically and operationally from the prior art. There is a large market for FPS devices if the cost and performance are competitive with existing (larger and heavier) products. The FPS system places an ultrathin low-frequency cone driver inside a folding enclosure that provides extended frequency response in a lightweight, flat portable configuration. The main features are 1) the construction of an unusually shallow low-frequency driver, and 2) the construction of an acoustic enclosure that may be folded flat when not in use. Both of these features are preferred in order for the FPS to realize its size vs. performance advantage.

Figure 1:
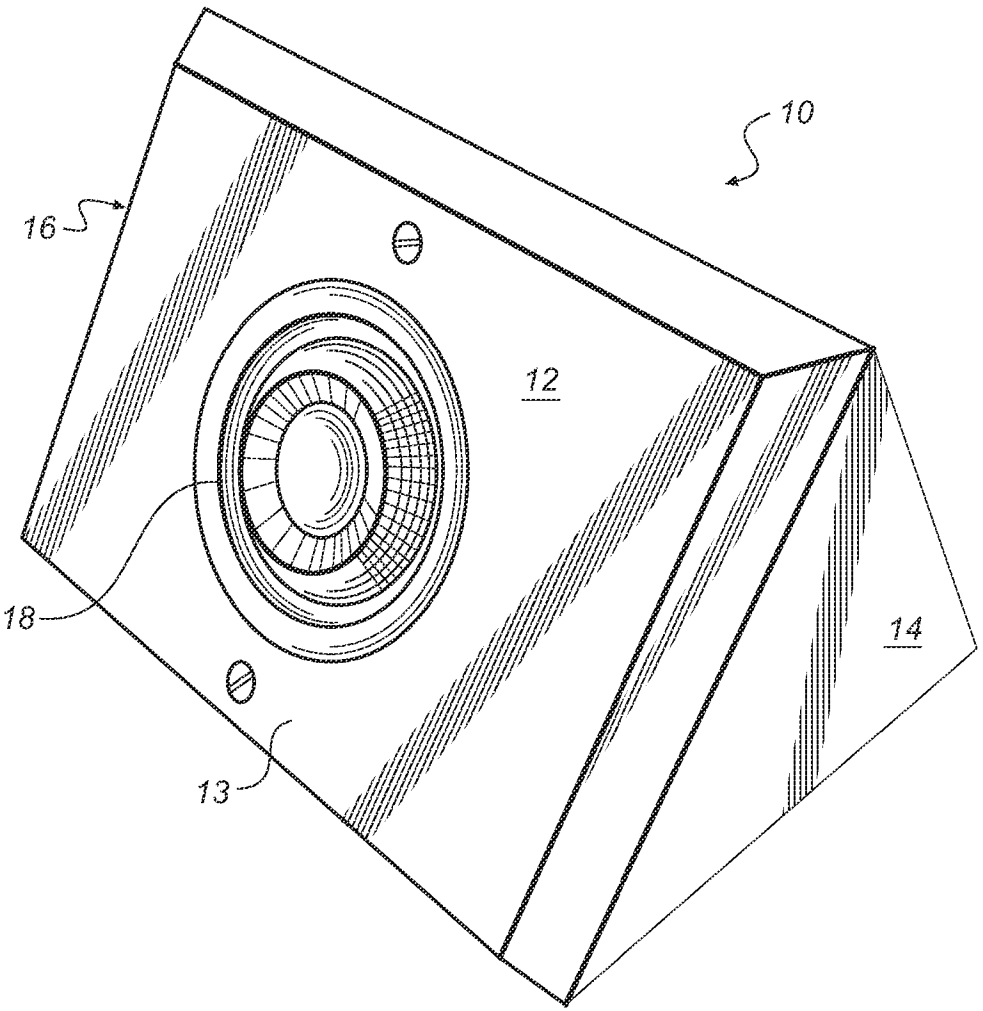
FIG. 1 is a perspective view of Folding Portable Speaker (FPS) in a deployed (open) configuration.

Referring to FIG. 1, the FPS 10 is shown in a deployed (open) configuration. Surfaces of the FPS (e.g. 12, 14) lock together to form a functional acoustic enclosure (i.e. substantially air tight) 16 which enables a driver 18 to reproduce the desired low-frequency audio content. A typical enclosure shape might be a rectangle 5"×7" on the front (12), rear and bottom, 5" equilateral triangle on the ends (including surface 14), and have a volume around 75 ci. The enclosure performance may be enhanced by the use of tuned ports (not shown).

Figure 2:
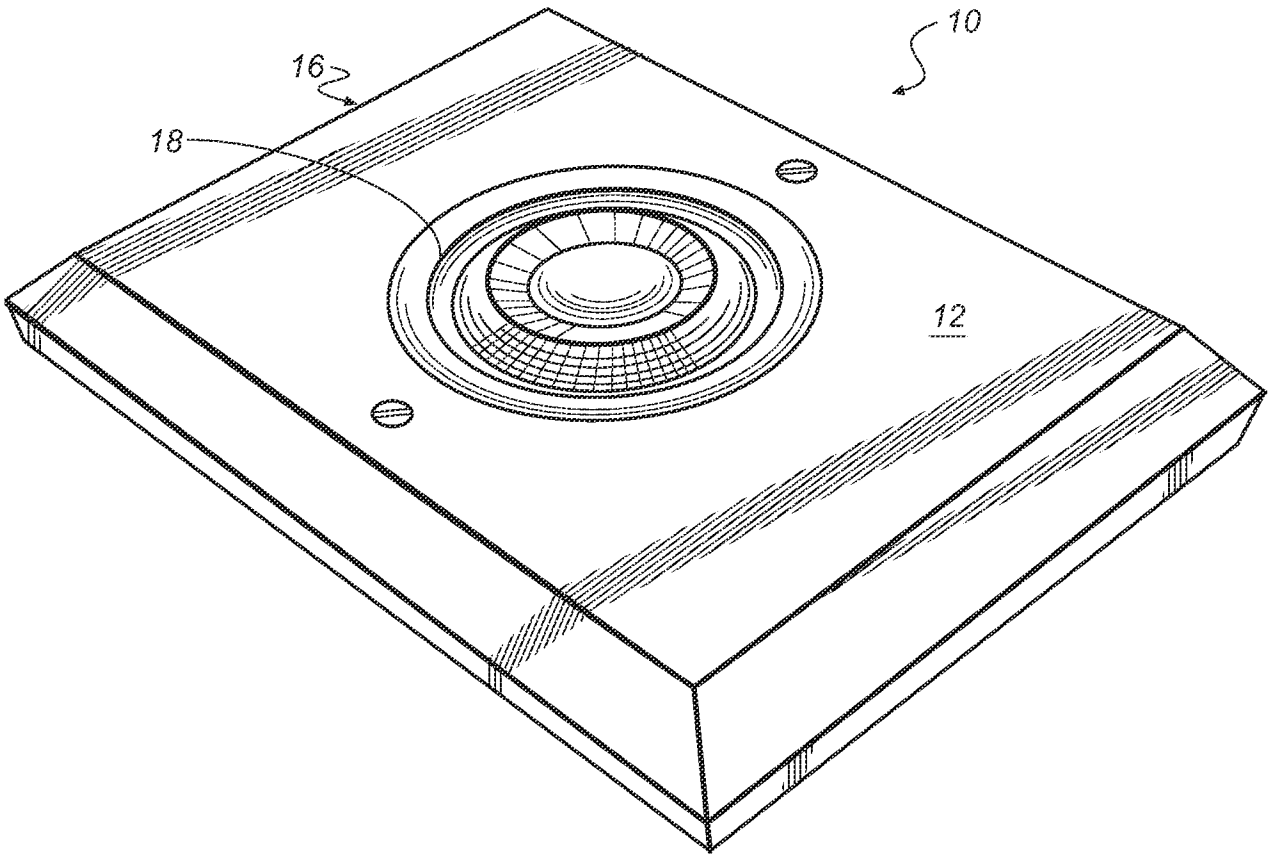
FIG. 2 is a perspective view of the FPS of FIG. 1 in a flat (closed) configuration.
Figure 3:
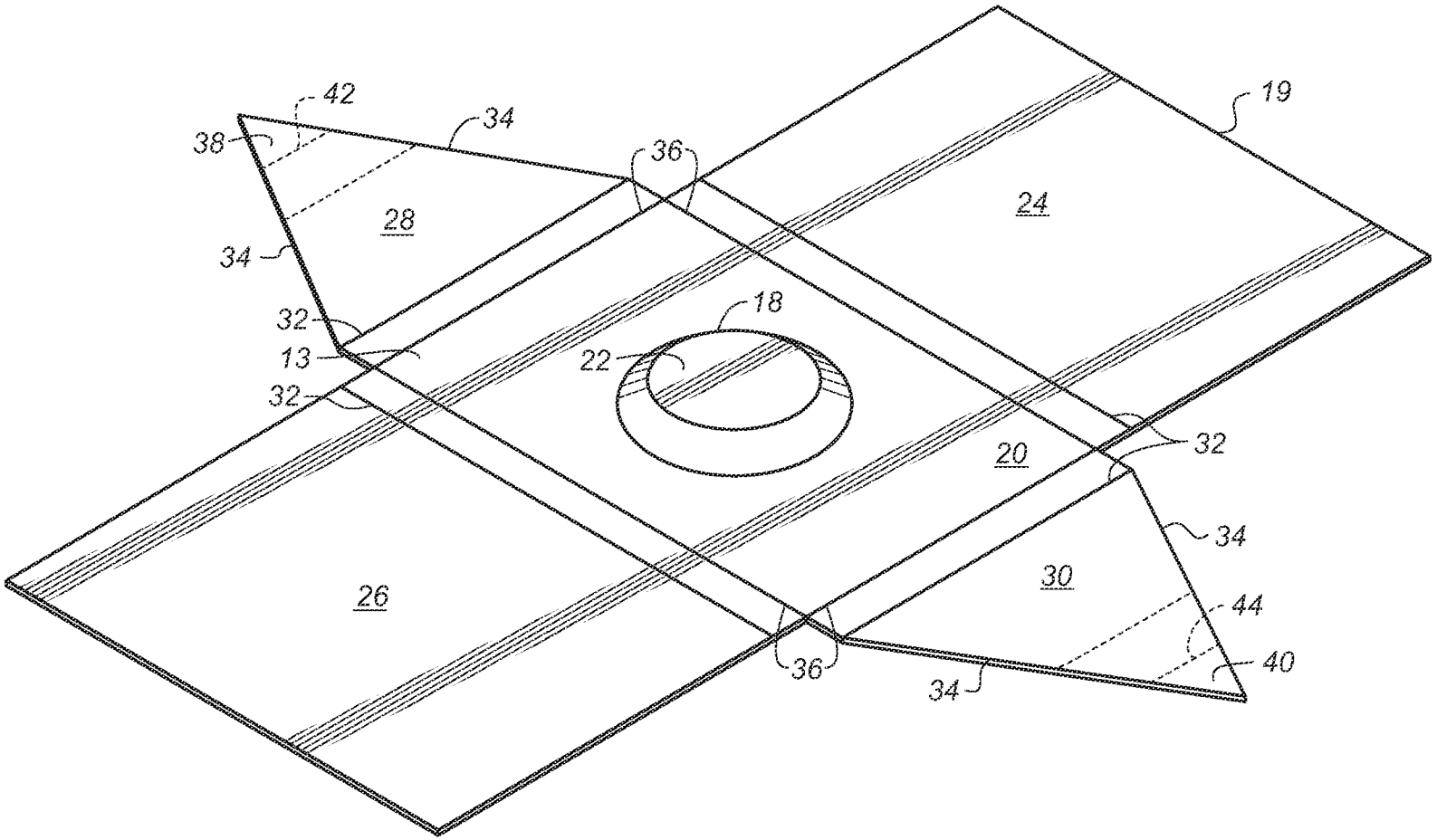
FIG. 3 is a perspective view of a composite sheet used in fabrication of a folding enclosure.

FIG. 2 shows the FPS 10 in a folded flat (closed) configuration. When the FPS 10 is not in use, some of the surfaces (e.g. surface 14) can be folded inward toward a plane of the low-frequency driver surface 12 (of a baffle 13) forming an overall thin structure which may be stored flat in a pocket, purse or briefcase. An optional power source and amplifier (both not shown) are contained within the residual volume of the flat (closed) structure. The thickness of the closed configuration might be approximately ⅝", giving an open/closed volume ratio of about 75/22 ci or about 3.4×. Reducing the thickness to ½" improves the volume ratio further to 75/17.5 ci or about 4.3×. From a marketability perspective, this is considered "thin" compared to other comparable choices and this form factor is likely to be well received by end users. The enclosure 16 has a triangular prismatic shape in the deployed state, and folds up into a relatively flat (~½" thick) rectangle in the closed state. The depth of the folded state is determined by the thickness of the driver 18 and by the thickness of the enclosure sheet material Turning to FIG. 3, in its preferred embodiment, the enclosure 16 is to be cut out and fabricated from a single flat sheet of composite material 19. This composite material may be fabricated by laminating thin aluminum sheet onto both sides of a polypropylene or polyethylene core. The presently-identified sample composite product, brand name Hylite, is manufactured by 3 A Composites Gmbh of Germany. This material has a total thickness of 2 mm (79 mils), and is composed of a polypropylene core of thickness=1.6 mm (63 mils) bonded on each side to an aluminum skin of thickness=0.2 mm (8 mils). Polypropylene is chosen because it has the best material characteristics for in-situ fabrication of reliable living hinges. Polyethylene has also been used for living hinge fabrication.

The low-frequency speaker driver 18 is mounted into a face 20 of the composite enclosure 16. In one implementation, the speaker cone/surround/voice-coil assembly of the driver 18 is glued directly into a large (3") round hole in the baffle surface 12. The rear assembly 22 (magnet structure) is fastened to the rear face 20 of the baffle 13 at locations adjacent to the perimeter of the baffle hole, and is positioned precisely relative to the voice coil. Optional high-frequency stereo and/or surround speakers (not shown) may also be mounted into the baffle 13 or into a different surface of the enclosure 16. The other surfaces (faces) 24 (base), 26 (top), 28 (left end) and 30 (right end) of the composite enclosure 16 are connected to the low-frequency driver surface 12 by hinge means 32, which are preferentially living hinges formed within the composite material during sheet fabrication (described further below).

Many sheet-metal fabrication methods can be used to form this material. The edges 34 can be profiled to present a poly-only butt contact to adjacent surfaces 24 and 26. Grooves machined into one side can be used to form inside- or outside-bends with different profiles (inside grooves along lines 36). Most uniquely, living hinges 32 can be fabricated within this material by machining matching grooves into both sides, leaving typically 16-18 mils poly thickness at the hinge axis.

The peripheral edges of the baffle 13 (front panel containing the driver 18) are bent to create the proper internal depth for the driver 18, and to position the hinged top 26, base 24 and end panels 28 and 30 to fold over each other. The end panels 28 and 30 fold in first, followed by the top 26 and then the base 24. The hinge positions are designed to allow the panels to fold flat, e.g. the end panel hinges are closest to the baffle face, followed by the top hinge and then the base hinge. Outer tips 38 and 40 of the end panels 28 and 30 may be specially chamfered so that both left and right ends can overlay for minimum total thickness.

Also, the outer tip(s) 28, 30 of the end panel(s) 28, 30 may be cut short at 42 and 44 so that a port opening(s) may be realized. Port length may be determined by a short lateral panel(s) parallel to the baffle, hinged from or placed adjacent to the edges formed by cutting off the tips 38 and 40 of the end panels 28 and 30. The port thus formed has a triangular prismatic shape, and may be tuned by adjusting the opening size and port length according to standard industry practice.

Figure 4:
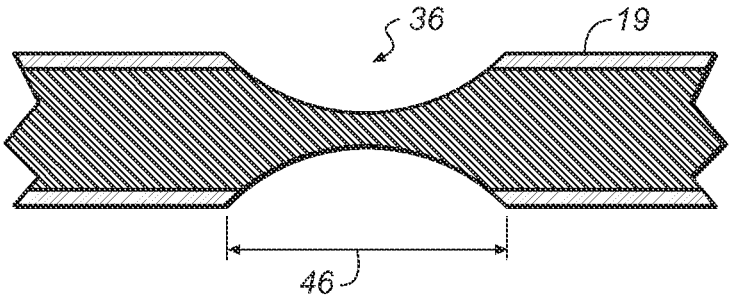
FIG. 4 is a view of a living hinge in an unbent position.
Figure 5:
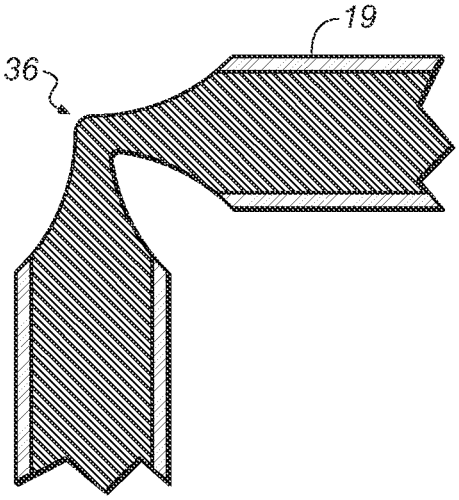
FIG. 5 is a view of the living hinge of FIG. 4 in a 90 degree bent position.

Referring to FIG. 4, the groove profile may typically be of circular cross-section, which avoids concentrating the bending stresses and makes premature failure of the hinge less likely. The dimension 46 is 3.72 mm and the depth of each arc is between about 0.41 mm to about 0.46 mm. The diameter and depth of cut determine the hinge stiffness and allowable angles of flexure, as shown in FIG. 5. A prototype uses aluminum panels joined with duct tape, which provides the function of living hinges.

Using living hinges preserves the rigidity of the material, helps maintain acoustic integrity by preventing leaks, and prevents vibration along the hinged edges of the enclosure 16 which could introduce undesirable noise. Along un-hinged interface edges, the ability to bullnose or contour back the aluminum surface skin (thus profiling the edges to produce a poly-only contact line) helps prevent noise at these critical locations. Also along un-hinged interface edges, the butting edge (e.g. 34 in FIG. 3) may be shaped with a slight convex curve, such that when the mating surface is drawn into close proximity and tightened, the tension due to deformation of the mating surface along the curved butting edge maintains a fixed position and uniform tension thus preventing undesirable vibration.

A means must be provided for the user to easily open and close the FPS. In the folded flat (closed) configuration (FIG. 2), the enclosure 16 may be unlatched by depressing a button-detent or by equivalent means. The enclosure 16 is opened either by spring means, by pulling a tab or filament, or using a combination of methods. In the open state, the un-hinged edges should be held tightly using flanges, mechanical tension, spring means, detent means incorporated into the surfaces near the edges, or by a combination of the above. Recognizing that others are possible, two methods of deployment are detailed below.

Figure 6:
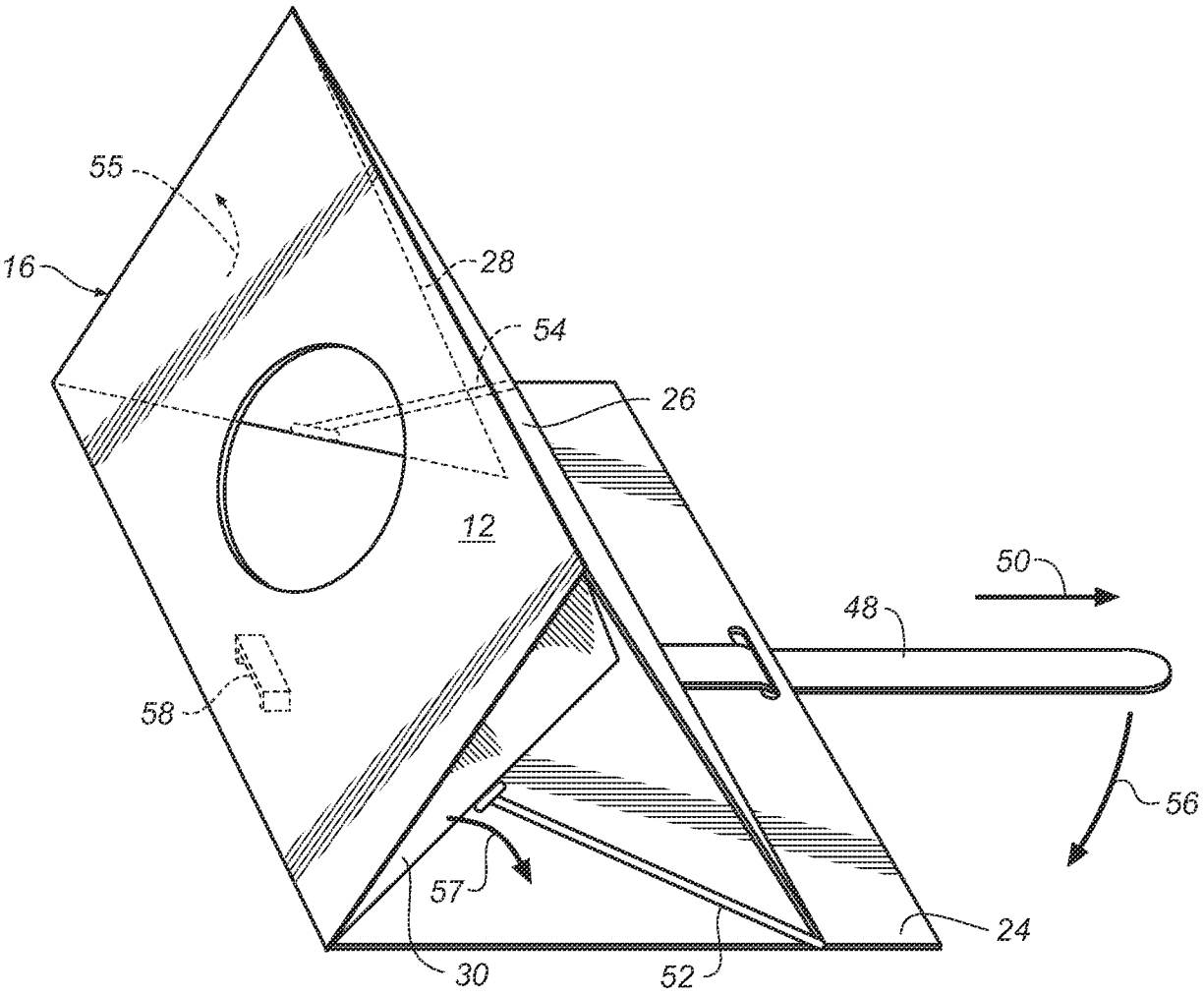
FIG. 6 is a perspective view of a first method of deploying the FPS.

A first method of deployment is shown in FIG. 6. The driver 18 is not shown. The base 24 is unfolded from the rest of the enclosure 16. A semi-rigid tab 48 located at the rear of the base 24 is pulled away from the unit towards a rear direction 50. The other end of the tab 48 connects (by flexible or hinge means) to the lower unhinged edge of the top 26, which slides toward the rear 50 until it reaches a fixed position and/or hits a stop. Simultaneously with opening the top 26, linking mechanisms 52 and 54 connecting the top panel 26 (or the tab 48) to the end panels 28 and 30, and/or a spring mechanism, cause the rear corners of the end panels 28 and 30 to spread out toward the sides in respective directions 55 and 57, where they hit a stop and/or are held in position by the linking mechanisms 52 and 54.

Having pulled the tab 48 out fully toward the rear direction 50, the user now rotates the tab 48 down and forward in the direction 56 to a position flat on the bottom of the base 24, in which position the tab 48 is held in place by a detent 58 or other positioning means. Tension is placed on the rear portion of the semi-rigid tab 48, caused by the rotating forward of the tab by the user and by the designed dimensions of the tab 48, its position of fixation near the rear edge of the top 26, and its position relative to the base 24. This tension is designed to hold the edge interfaces of the enclosure 16 tightly together, minimizing noise due to vibration. These edge interfaces exist between the top 26 and the end panels 28 and 30, between the base 24 and the end panels 28 and 30, and between the top 26 and base panel 24 at the rear edge.

Figure 7:
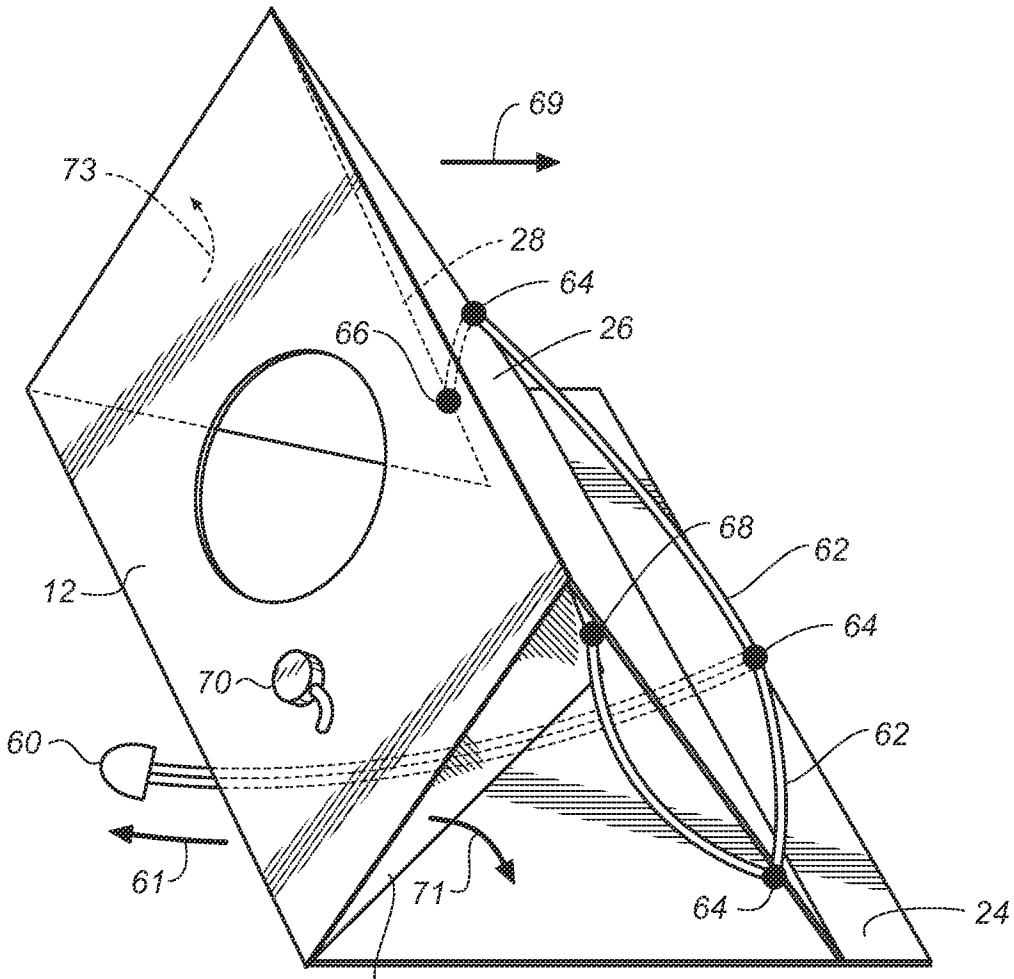
FIG. 7 is a perspective view of a second method of deploying the FPS.

A second method of deployment is shown in FIG. 7. The base 24 is unfolded and a tab or loop 60 (located at the rear of the base 24) is pulled by a user in the direction of an arrow 61. The tab or loop 60 is connected to a filament(s) 62, which together with guides and/or holes 64, wraps around the left and right edges of the top panel 26 and connects to locations 66 and 68 along the upper edge of the end panels 28 and 30. When the user pulls the tab or loop 60, the filament 62 pulls initially on the top panel 26 causing it to begin to open in the direction of an arrow 69. Subsequently the filament 62 pulls outward on the rear corners of the end panels 28 and 30, causing them to spread open (i.e. panel 30 moves in the direction of an arrow 71 and panel 28 moves in the direction of an arrow 73) as the top panel 26 position allows. As the top panel 26 approaches its fully open position, the filament 62 pulls the end panels 28 and 30 to their fully open position. The user then affixes the tab or loop 60 to a fastening means 70, which tensions the filament 62 according to design, holding the edge interfaces tightly together as described previously. To close the FPS the user unlatches any detent, folds the triangular ends 28 and 30 inward (by pressing inward on the rear corners of the end panels 28 and 30), folds the rear of the top 26 inward, and finally folds the top edge of the front 12 down flat over the base 24, a closing latch detent holding the FPS unit closed.

Figure 8:
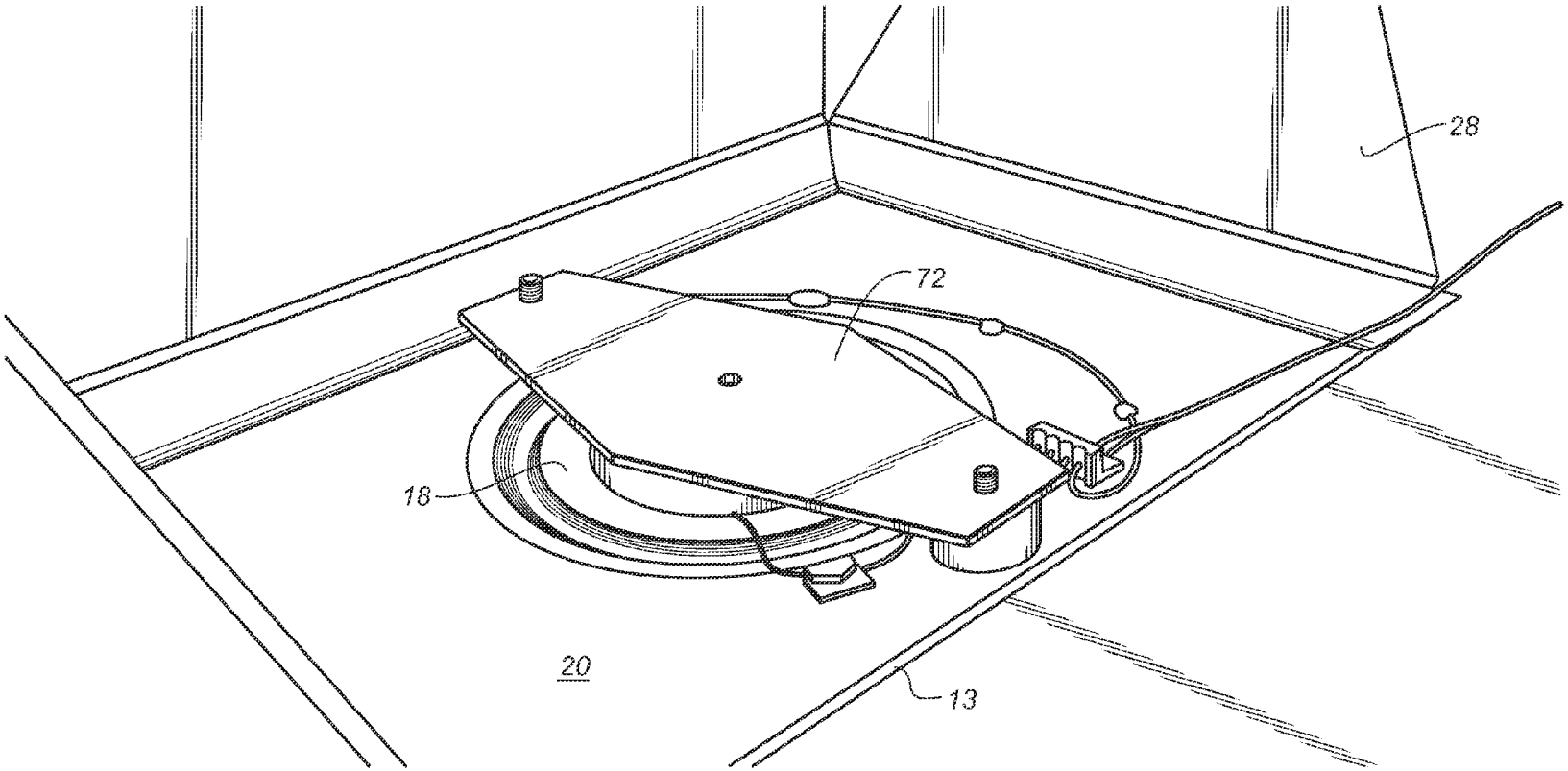
FIG. 8 is a perspective view of the internal construction of the FPS with a flat driver.

Turning to FIG. 8, the proposed driver 18 is a spiderless design with outside surround diameter of 3", equivalent to a nominal cone driver size of 3.5". The surround may be directly affixed to the aluminum or composite baffle 13 using black rubberized speaker cement, or may be fixed to a rigid subassembly which is then mated to the baffle 13. A disc (or donut) shaped NdBFe (neodymium) magnet is positioned inside the voice coil (VC), topped by a larger-diameter steel washer (pole-piece) which concentrates the field at the center of the VC. A steel backplate 72 and outer ring (preferably formed to create a symmetric magnetic field) steer the magnetic field to the outer side of the VC gap. The backplate may be used as a structural mounting element as shown in FIG. 8.

Figure 9:
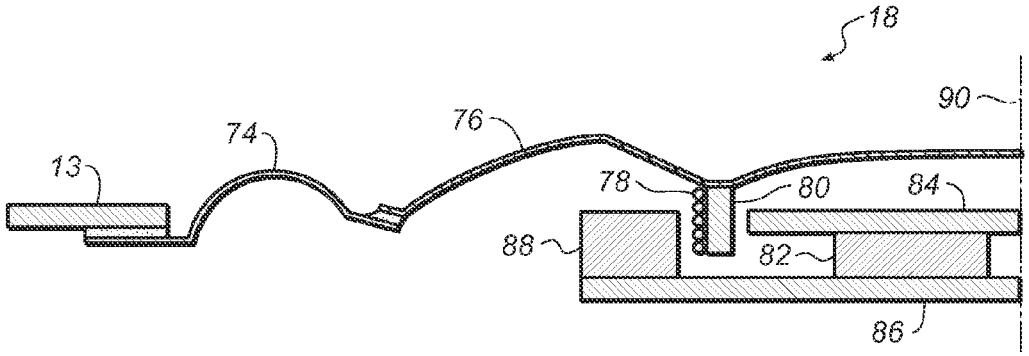
FIG. 9 is a cross-sectional view of the structure of a flat driver.

Referring to FIG. 9, the specification for a 3.5" nominal diameter thin driver 18 mentioned above is as follows. An outer diameter of a rubber surround 74 is 3.0". The effective diameter Deff is 2.5". The outer diameter of a paper cone 76 is 2.0". The voice coil maximum travel Xmax is +/−1/16" (63 mils). A VC 78 with a former 80 has a diameter of 1.1", a length of 3/16", a resistance of 4 ohms, and includes 4 layers of 32 awg insulated magnet wire. A ring magnet 82 (NdBFe) has a diameter of 5/8" and a thickness of 3/16". A steel washer pole piece 84 and a steel backplate 86 each have a thickness of 1/16". An outer ring 88 is made of a 0.25"L section of 1 1/4" iron pipe with an inside diameter of 1.37" and an outside diameter of 1.63". A center axis 90 of the speaker driver is shown.

Total thickness Ttot of the driver is determined by the baffle thickness Tbaf, forward protrusion of the cone 76 dTcone (determined by cone shape and relative position of cone-to-baffle), and the rear assembly depth. The rear assembly depth is in turn determined by the required Xmax, and thickness of the center pole-piece (including the magnet 82) and backplate 86 (Tsteel).

$$Ttot=Tbaf+dTcone+3*Xmax+2*Tsteel=1/16"+1/16"+3*1/16"+2*1/16"=7/16"$$

Figure 10:
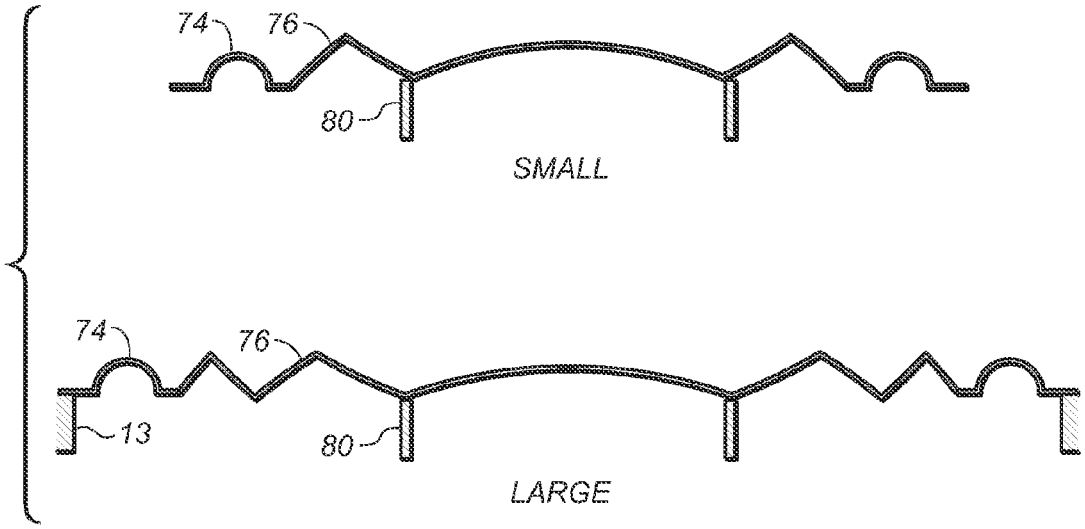
FIG. 10 are cross-sectional views of two cone profiles.

The shaped cone 76 has a significant thickness due to the 3-dimensional profile required to create stiffness. The spherical surface is folded into a concentric structure (FIG. 8) with overall thickness less than ~0.2". Two possible profile cross-sections through the center of the cone 76 are shown in FIG. 10. More folds will create a thinner structure, however stiffness is gradually lost as a smaller proportion of the cone 76 has the desired steep-angled profile. Note that the dynamic cone protrusion (due to Xmax~1/16") can in theory be mechanically compressed into the structure (by Xmax=1/16") when the FPS is folded into the closed position. Note also that it may be desirable to add a margin to the designed Xmax to allow for ballistic excursion, and thus prevent noise produced by the VC form contacting the backplate 86.

As an alternative, multiple small-thin-low-Xmax drivers could be used to get similar performance. The proposed new design driver 18 for the 5×7 enclosure has a target Xmax=+/−63 mils (1/16"), an effective diameter Deff=2.5" and displacement dV of:

$$\text{New design: } dV=+/-0.5*Xmax*pi*Deff^2=+/-0.614 \text{ ci(in}^3)$$

One sample type of small thin 2" nominal cone driver has thickness=0.25", Deff=1.5" and guestimated Xmax=+/−31 mils (1/32"). For these particular devices, displacement dV is approximately: Existing 2" driver: dV=+/−0.11 ci, so with 4 speakers dV=0.44 ci or 72% of the prior result. If a larger version of the new-design driver has Deff=3.25" and xmax=+/−63 mils then: New design large: dV=+/−1.045 ci, which is 1.7× the existing new design version.

It is possible to integrate the FPS with (or into) an integrated case which holds and protects a portable electronic device (PED) which provides the audio source signal. As envisioned, the FPS and PED case could be concurrently fabricated from the same piece of sheet material, or could be fabricated separately and joined together using any of a variety of techniques generally known. The PED case functionality may include the ability to position the PED in different ways to optimize end user interaction.

It is possible to use the FPS as a simple subwoofer to supplement existing high-frequency (HF) speakers/drivers such as might be present in small portable electronic devices (PED). If the FPS system is to be used without other HF drivers, it may be desirable to locate one or two small HF drivers within the FPS, e.g. attached to the inside of the baffle 13 next to the low-frequency (LF) driver 18. In this configuration, the FPS functions as a full-range 2-way speaker system, with stereo capability in the case of two HF drivers, mounted to the left and right of the LF driver 18.

Regarding electronics, it is possible to use the FPS with external signal amplification and power source. However, due to the small and light-weight nature of the FPS system, optimum functionality and convenience are experienced when the system can be used stand-alone, i.e. with only a low-power PED signal source. Thus, it is desirable to integrate a power source and amplifier into the system, along with means to connect to the amplifier and to charge the power source. These functions would be implemented according to standard practice of those with ordinary knowledge in the art.

To conclude, a folding enclosure is preferentially fabricated from a composite-sheet. A flat (thin or reduced-depth) low-frequency speaker driver 18, for example a cone driver of spiderless design is used in the FPS. A flat driver capable of significant displacement (significant low frequency audio output) is preferable. Optionally, a case for the portable electronic device may be included which is integrated with the composite-sheet enclosure, and possibly concurrently fabricated from the same composite-sheet material. Optionally, 1 or 2 small high-frequency speaker drivers may be included which are required for left-right stereo imaging. Optionally, any or all of the following support electronics may be provided: a power source and amplifier to drive the speaker, a means of electrical connection to the portable electronic device which provides the source signal, and a charging means for the power source.

A number of implementations have been described. Nevertheless, it will be understood that additional modifications may be made without departing from the scope of the inventive concepts described herein, and, accordingly, other embodiments are within the scope of the following claims.

What is claimed is:

1. A deployable speaker, comprising:

a driver;

an acoustic enclosure made up of a multiplicity of panels, the driver being secured to one of the panels, the acoustic enclosure being deployable from a closed state to a deployed state, wherein when one of the panels is moved by a user from the closed to the deployed state, all but one of the remaining panels are simultaneously moved from the closed to the deployed state;

wherein all of the panels which make up the enclosure are unitary and formed on a single sheet; and wherein a living hinge connects each panel to at least one other panel.

2. The speaker of claim 1, wherein the enclosure has a total of five panels.

3. The speaker of claim 1, further including a pair of link mechanisms which both have one end connected to the one panel that is moved by the user and the other end connected to a respective other panel.

4. The speaker of claim 1, further including one or more filaments which are connected to all but one of the panels and are pulled by the user to move the all but one of the panels from the closed state to the deployed state.

5. The speaker of claim 1, wherein in the deployed state all but one of the panels each has at least two edges that engage with a respective portion of at least two other panels, and in the closed state the at least two edges of the all but one of the panels are not engaged with the respective portions of the at least two other panels.

6. The speaker of claim 5, wherein in the deployed state a first two of the panels each have two edges that engage with a respective portion of two other panels, and a second two of the panels each have three edges that engage with a respective portion of three other panels.

7. The speaker of claim 1, wherein the acoustic enclosure is substantially air tight.

8. The speaker of claim 1, wherein the enclosure includes at least one opening which functions as a port.

9. The speaker of claim 1, wherein the enclosure has a passive radiator.

10. The speaker of claim 1, further including one or more of a battery, an amplifier and electronics which are contained in the enclosure.

11. A method of deploying a speaker from a closed state to an deployed state, comprising:

providing an enclosure in a closed state which is made up of a multiplicity of panels, a driver being secured to one of the panels;

unfolding a first one of the panels from the remaining panels;

moving a deployment element to cause the remaining panels to simultaneously move from respective first positions to respective second positions in which the enclosure is in the deployed state;

wherein all of the panels which make up the enclosure are unitary and formed on a single sheet; and wherein each of the unfolding and moving steps are enabled by living hinges which join the panels together.

12. The method of claim 11, wherein the driver is secured to a second one of the panels.

13. The method of claim 11, wherein the deployment element is a tab which is pulled by a user to cause the moving step.

14. The method of claim 11, further including securing the deployment element to lock the enclosure in the deployed state.

15. The method of claim 14, wherein the deployment element is moved in a first direction to cause the remaining panels to simultaneously move from respective first positions to respective second positions, and is moved in a second direction to secure the deployment element.

16. The speaker of claim 11, wherein the enclosure includes at least one opening which functions as a port.

17. The speaker of claim 11, wherein the enclosure has a passive radiator.

18. The speaker of claim 11, further including one or more of a battery, an amplifier and electronics which are contained in the enclosure.

* * * * *